US010591857B1

(12) United States Patent
Akiyama

(10) Patent No.: US 10,591,857 B1
(45) Date of Patent: Mar. 17, 2020

(54) IMAGE FORMING APPARATUS AND CONTROL METHOD OF IMAGE FORMING APPARATUS EFFICIENTLY DURING DECOLORIZATION

(71) Applicant: TOSHIBA TEC KABUSHIKI KAISHA, Shinagawa-ku, Tokyo (JP)

(72) Inventor: Yuuichi Akiyama, Numaza Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/163,664

(22) Filed: Oct. 18, 2018

(51) Int. Cl.

| | |
|---|---|
| ***G03G 15/20*** | (2006.01) |
| ***G03G 15/36*** | (2006.01) |
| ***G03G 9/09*** | (2006.01) |
| ***G03G 15/22*** | (2006.01) |
| ***G03G 15/00*** | (2006.01) |

(52) U.S. Cl.
CPC ..... *G03G 15/36* (2013.01); *G03G 9/0926* (2013.01); *G03G 15/20* (2013.01); *G03G 15/205* (2013.01); *G03G 15/206* (2013.01); *G03G 15/2039* (2013.01); *G03G 15/22* (2013.01); *G03G 15/6585* (2013.01); *G03G 15/2028* (2013.01); *G03G 15/2064* (2013.01); *G03G 2215/209* (2013.01)

(58) Field of Classification Search
CPC ..... G03G 15/36; G03G 15/22; G03G 15/20; G03G 9/0926; G03G 15/2028; G03G 15/2032; G03G 15/2039; G03G 15/205; G03G 15/206; G03G 15/2064; G03G 15/1695; G03G 2215/1666; G03G 15/6585; G03G 2215/209
See application file for complete search history.

(56) References Cited

U.S. PATENT DOCUMENTS 3,965,331 A * 6/1976 Moser ..... G03G 15/2064 219/216
4,928,148 A * 5/1990 Higashi ..... G03G 15/0105 219/469

(Continued)

FOREIGN PATENT DOCUMENTS

JP 2010-271555 12/2010

*Primary Examiner* — David M. Gray
*Assistant Examiner* — Laura Roth
(74) *Attorney, Agent, or Firm* — Amin, Turocy & Watson, LLP

(57) ABSTRACT

An image forming apparatus according to one embodiment includes a transport unit, an image forming unit, a heating member, a first pressurizing member, a second pressurizing member, and a processor. The transport unit is configured to transport a print medium. The image forming unit is configured to form a toner image on the print medium by a first toner. The first pressurizing member is configured to form a fixing nip for fixing with the heating member. The second pressurizing member is configured to form a decolorizing nip for decolorizing with the heating member. The processor is configured to control the heating member to the first temperature, allows the print medium on which the toner image is formed by the first toner to pass through the fixing nip, and allows the print medium on which an image is formed by a second toner, to pass through the decolorizing nip.

14 Claims, 7 Drawing Sheets

(56) References Cited

U.S. PATENT DOCUMENTS

| | | | | | |
|---|---|---|---|---|---|
| 5,296,904 | A * | 3/1994 | Jackson | G03G 15/0105 | 219/216 |
| 5,325,165 | A * | 6/1994 | Ohgita | G03G 15/0105 | 219/216 |
| 5,408,301 | A * | 4/1995 | Tokishige | G03G 15/0105 | 219/216 |
| 7,529,514 | B2 * | 5/2009 | Tamura | G03G 15/205 | 399/328 |
| 8,121,505 | B2 * | 2/2012 | Jackson | G03G 15/0131 | 399/321 |
| 8,275,300 | B2 * | 9/2012 | Bobo | G03G 15/2064 | 399/341 |
| 8,331,842 | B2 * | 12/2012 | Bobo | G03G 15/657 | 219/216 |
| 9,207,604 | B1 * | 12/2015 | Ise | G03G 15/2064 | |
| 2016/0136987 | A1 * | 5/2016 | Yahata | B41M 7/0009 | 347/179 |
| 2018/0067424 | A1 * | 3/2018 | Mizutani | G03G 15/6582 | |

* cited by examiner

IMAGE FORMING APPARATUS AND CONTROL METHOD OF IMAGE FORMING APPARATUS EFFICIENTLY DURING DECOLORIZATION

FIELD

Embodiments described herein relate generally to an image forming apparatus and a control method of the image forming apparatus.

BACKGROUND

An image forming apparatus includes an image forming unit that forms a toner image on a print medium and a fixing unit that fixes the toner image onto the print medium by applying heat and pressure to the print medium. The image forming unit can form the toner image on the print medium by a colorant (decolorable toner) that is decolorized (colorless) by being heated at a predetermined temperature (decolorizing temperature). The image forming unit can form the toner image on the print medium by a usual colorant (color toner) that cannot be decolorized. In addition, a decolorizing device that takes in the print medium on which an image is formed with a decolorable toner and heats the print medium at a decolorizing temperature to decolorize the image on the print medium is in practical use. Also, an image forming apparatus equipped with the decolorizing device is in practical use.

For example, the image forming apparatus equipped with the decolorizing device takes in the print medium on which the image is formed with the decolorable toner and allows the print medium to pass through a transport path for fixing to decolorize the image. With such a configuration, there is a problem that printing and decolorizing cannot be performed at the same time.

For example, some image forming apparatuses equipped with a decolorizing device include a fixing heater and a decolorizing heater. With such a configuration, there is a problem that power consumption is increased when printing and decolorizing are performed at the same time.

DETAILED DESCRIPTION

An image forming apparatus according to one embodiment includes a transport unit, an image forming unit, a heating member, a first pressurizing member, a second pressurizing member, and a processor. The transport unit is configured to transport a print medium. The image forming unit is configured to forma toner image on the print medium by a first toner that is fixed at a first temperature. The first pressurizing member is configured to forma fixing nip for fixing with the heating member. The second pressurizing member is configured to form a decolorizing nip for decolorizing with the heating member. The processor is configured to control the heating member to the first temperature, allows the print medium on which the toner image is formed by the first toner to pass through the fixing nip, and allows the print medium on which an image is formed by a second toner, which is fixed at a second temperature lower than the first temperature and is decolorized at a third temperature which is higher than the second temperature and lower than the first temperature, to pass through the decolorizing nip.

Hereinafter, an image forming apparatus and a control method of the image forming apparatus according to one embodiment will be described with reference to the drawings.

Figure 1:
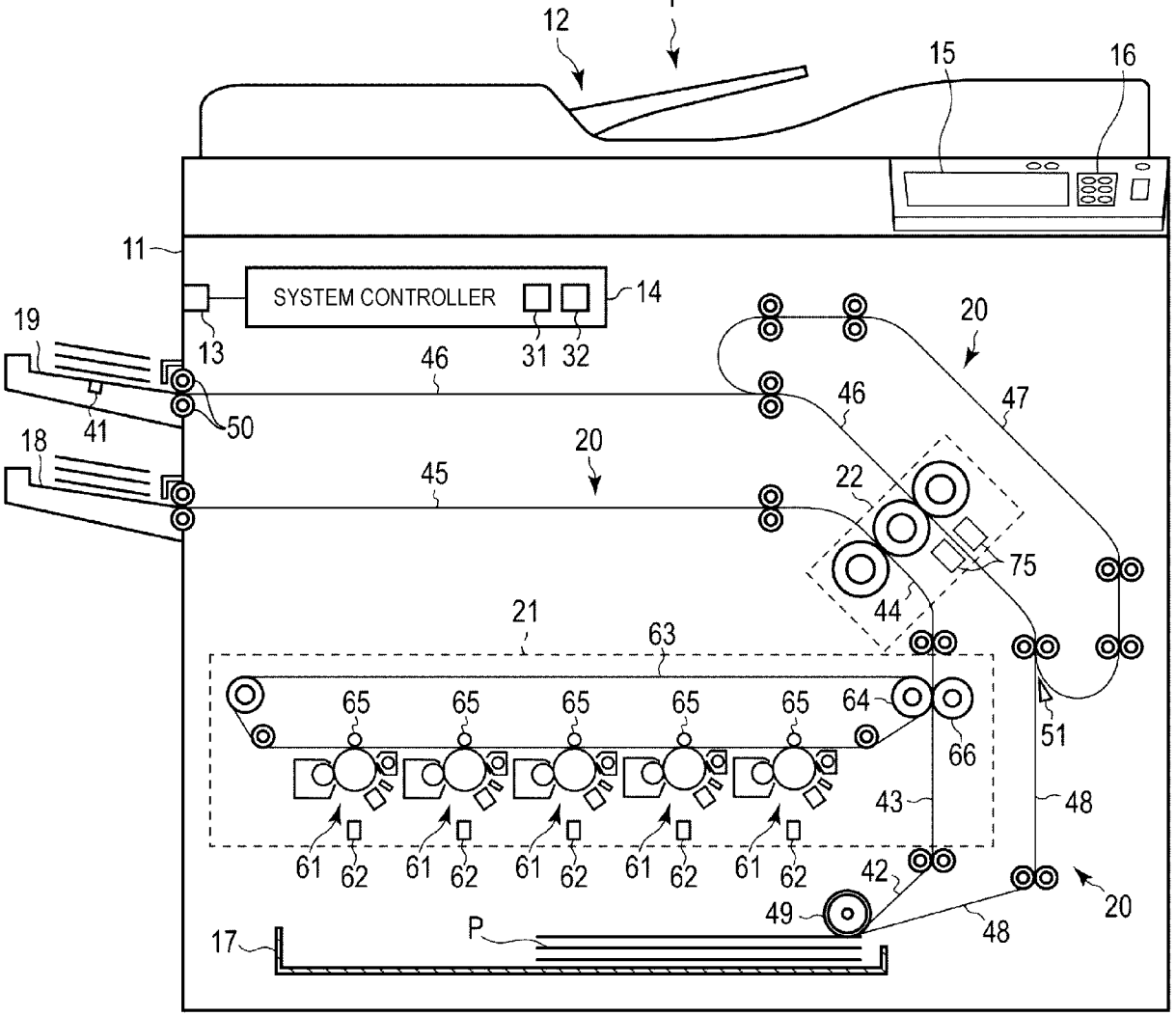
FIG. 1 illustrates a diagram for explaining a configuration example of an image forming apparatus according to one embodiment.

FIG. 1 illustrates an explanatory diagram for explaining a configuration example of an image forming apparatus 1 according to the embodiment.

The image forming apparatus 1 is, for example, a multifunction printer (MFP) that performs various processing such as image formation while transporting a recording medium such as a print medium. The image forming apparatus 1 is, for example, a solid-state scan type printer (for example, an LED printer) that scans an LED array that performs various processing such as image formation while transporting a recording medium such as a print medium.

For example, the image forming apparatus has a configuration in which an image is formed on a print medium by a color toner (first toner) and a configuration in which an image is formed on the print medium by a decolorable toner (second toner).

The color toner is a toner of a color such as cyan, magenta, yellow, black, and the like, and is an ordinary toner which cannot be decolorized. The color toner is melted and fixed at a temperature equal to or higher than a predetermined fixing temperature (first temperature). The first temperature is, for example, 180° C.

The decolorable toner is a toner which is decolorized by external stimulation. Decolorizing indicates that an image formed with a color different from the color of the print medium which is a base becomes visually invisible (for example, becomes colorless). The decolorable toner is melted and fixed at a temperature equal to or higher than a predetermined fixing temperature (second temperature). The second temperature is lower than the first temperature. The second temperature is, for example, 100° C. The external stimulation is, for example, heating at a temperature equal to or higher than a predetermined decolorizing temperature (third temperature). The third temperature is higher than the second temperature and lower than the first temperature. The third temperature is, for example, 140° C.

As illustrated in FIG. 1, the image forming apparatus 1 includes a casing 11, an image reading unit 12, a communication interface 13, a system controller 14, a display unit 15, an operation interface 16, a paper cassette 17, a paper discharge tray 18, a decolorization tray 19, a transport unit 20, an image forming unit 21, and a fixing decolorizing device 22.

The casing 11 is a main body of the image forming apparatus 1. The casing 11 accommodates the image reading unit 12, the communication interface 13, the system controller 14, the display unit 15, the operation interface 16, the paper cassette 17, the paper discharge tray 18, the decolorization tray 19, the transport unit 20, the image forming unit 21, and the fixing decolorizing device 22.

The image reading unit 12 is configured to read an image from an original document. The image reading unit 12 includes, for example, a scanner. The scanner acquires an image of the original document under control of the system controller 14.

The communication interface 13 is an interface for communicating with another device. The communication interface 13 is used for communication with a host device (external device), for example. The communication interface 13 is configured as, for example, a LAN connector. Further, the communication interface 13 may perform wireless communication with another device according to a standard such as Bluetooth (registered trademark) or Wi-fi (registered trademark).

The system controller 14 controls the image forming apparatus 1. The system controller 14 includes, for example, a processor 31 and a memory 32. The system controller 14 is connected to the image reading unit 12, the transport unit 20, the image forming unit 21, the fixing decolorizing device 22, and the like via a bus or the like.

The processor 31 is an arithmetic element for executing arithmetic processing. The processor 31 is, for example, a CPU. The processor 31 performs various processing based on data such as a program stored in the memory 32. The processor 31 functions as a control unit capable of executing various operations by executing the program stored in the memory 32.

The memory 32 is a storage medium that stores programs and data used in the programs. The memory 32 also functions as a working memory. That is, the memory 32 temporarily stores data being processed by the processor 31, a program to be executed by the processor 31, and the like.

The processor 31 executes the program stored in the memory 32 to control the image reading unit 12, the transport unit 20, the image forming unit 21, and the fixing decolorizing device 22.

The display unit 15 includes a display for displaying a screen in accordance with a video signal input from the system controller 14 or a display control unit such as a graphic controller (not illustrated). For example, on the display of the display unit 15, a screen for various settings of the image forming apparatus 1 is displayed.

The operation interface 16 is connected to an operation member (not illustrated). The operation interface 16 supplies an operation signal corresponding to the operation of the operation member to the system controller 14. The operation member is, for example, a touch sensor, a ten key, a power key, a paper feed key, various function keys, a keyboard, or the like. The touch sensor acquires information indicating a designated position within a certain region. The touch sensor is configured as a touch panel integrally with the display unit 15, thereby inputting a signal indicating the touched position on the screen displayed on the display unit 15 to the system controller 14.

The paper cassette 17 is a cassette for accommodating a print medium P. The paper cassette 17 is configured to be able to supply the print medium P from the outside of the casing 11. For example, the paper cassette 17 is configured to be able to be drawn out from the casing 11.

The paper discharge tray 18 is a tray for supporting the print medium P discharged from the image forming apparatus 1.

The decolorization tray 19 is a tray that supports the print medium P to be taken into the image forming apparatus 1. The decolorization tray 19 is provided with a sensor 41 for detecting whether or not the print medium P is disposed on the decolorization tray 19. The sensor 41 supplies the detection result to the system controller 14.

The transport unit 20 is a mechanism that transports the print medium P in the image forming apparatus 1. As illustrated in FIG. 1, the transport unit 20 includes a plurality of transport paths. For example, the transport unit 20 includes a paper feeding transport path 42, an image forming transport path 43, a fixing transport path 44, a paper discharge transport path 45, a decolorizing transport path 46, a re-decolorizing transport path 47, and a recursive transport path 48.

Each of the paper feeding transport path 42, the image forming transport path 43, the fixing transport path 44, the paper discharge transport path 45, the decolorizing transport path 46, the re-decolorizing transport path 47, and the recursive transport path 48 is configured with a plurality of motors (not illustrated), a plurality of rollers, and a plurality of guides. The plurality of motors rotate shafts based on control of the system controller 14 to thereby rotate the rollers interlocked with rotation of the shafts. The plurality of rollers rotate to thereby move the print medium P. The plurality of guides control the transport direction of the print medium P.

The print medium P is taken from the paper cassette 17 in the paper feeding transport path 42 and the taken print medium P is supplied to the image forming transport path 43. A pickup roller 49 is included in the paper feeding transport path 42. The pickup roller 49 takes in the print medium P of the paper cassette 17 into the paper feeding transport path 42.

The image forming transport path 43 is a transport path for receiving the print medium P from the paper feeding transport path 42 and passing the received print medium P through a transfer nip of the image forming unit 21 described later. A toner image is formed on the print medium P that is passed through the transfer nip of the image forming unit 21.

The fixing transport path 44 is a transport path for receiving the print medium P from the image forming transport path 43 and passing the received print medium P through a fixing nip of a fixing decolorizing device 22 described later. When the print medium P is passed through the fixing nip of the fixing decolorizing device 22, the toner image of the print medium P is fixed to the print medium P.

The paper discharge transport path 45 is a transport path for receiving the print medium P from the fixing transport path 44 and discharging the received print medium P from the casing 11. The print medium P discharged by the paper discharge transport path 45 is supported by the paper discharge tray 18.

The decolorizing transport path 46 is a transport path for taking in the print medium P from the decolorization tray and passing the taken-in print medium P through a decolorizing nip of the fixing decolorizing device 22. In the print medium P that is passed through the decolorizing nip of the fixing decolorizing device 22, an image formed by the decolorable toner is decolorized. A pickup roller 50 is included in the decolorizing transport path 46. The pickup roller 50 takes in the print medium P of the decolorization tray 19 into the decolorizing transport path 46.

The re-decolorizing transport path 47 is a transport path for passing the print medium P that is passed through the decolorizing nip of the fixing decolorizing device 22 again through the decolorizing nip. The re-decolorizing transport path 47 includes a guide 51 for switching a transport destination of the print medium P between the re-decolorizing transport path 47 and the recursive transport path 48 on the downstream side of the decolorizing nip of the decolorizing transport path 46. The guide 51 operates under the control of the system controller 14. As a result of controlling the guide 51, the print medium P is received from the decolorizing transport path 46, on the downstream side of the decolorizing nip of the decolorizing transport path 46, in the re-decolorizing transport path 47. The received print medium P is supplied to the upstream side of the decolorizing nip of the decolorizing transport path 46 in the re-decolorizing transport path 47.

The recursive transport path 48 is a transport path for receiving the print medium P from the decolorizing transport path 46 and supplying the received print medium P to the paper cassette 17. That is, in the recursive transport path 48, the print medium P is passed through the decolorizing nip of the fixing decolorizing device 22 and the print medium P of which image is decolorized is supplied to the paper cassette 17.

Next, the image forming unit 21 will be described.

The image forming unit 21 is configured to form an image on the print medium P based on the control of the system controller 14. Specifically, the image forming unit 21 forms an image on the print medium P based on a print job generated by the processor 31. The image forming unit 21 includes a plurality of process units 61, a plurality of exposing devices 62, a primary transfer belt 63, an opposing secondary transfer roller 64, a plurality of primary transfer rollers 65, and a secondary transfer roller 66.

First, a configuration relating to image formation of the image forming unit 21 will be described.

The process unit 61 is configured to form a toner image. For example, the plurality of process units 61 are provided for each type of toner. For example, the plurality of process units 61 correspond to color toners of cyan, magenta, yellow, black, and the like, and a decolorable toner, respectively. Since the plurality of process units 61 have the same configuration except for developer to be filled, one process unit 61 will be described.

The process unit 61 includes a photoconductive drum, an electrifying charger, and a developing device.

The photoconductive drum is a photoconductive body including a cylindrical drum and a photoconductive layer formed on the outer peripheral surface of the drum. The photoconductive drum rotates at a constant speed by a drive mechanism (not illustrated).

The electrifying charger uniformly charges the surface of the photoconductive drum. For example, the electrifying charger uses an electrifying roller to charge the photoconductive drum to a uniform negative potential. The electrifying roller is rotated by rotation of the photoconductive drum in a state where a predetermined pressure is applied to the photoconductive drum.

The developing device is a device for adhering the toner to the photoconductive drum. The developing device includes a developer container, a developing sleeve, and a doctor blade.

The developer container is a container for containing developer containing a toner and carrier. The developer is filled from a toner cartridge. The developing sleeve rotates in the developer container, thereby causing the developer to adhere to the surface of the developing sleeve. The doctor blade is a member disposed with a predetermined distance from the developing sleeve. The doctor blade adjusts a thickness of the developer adhering to the surface of the developing sleeve.

The plurality of exposing devices 62 are provided so as to correspond to the photoconductive drums of the process units 61, respectively. The exposing device 62 includes a light emitting element such as a laser diode or a light emitting diode (LED). The exposing device 62 irradiates the charged photoconductive drum with a laser beam by a light emitting element to form an electrostatic latent image on the photoconductive drum.

In the configuration described above, when a developer layer formed on the surface of the developing sleeve comes into contact with the surface of the photoconductive drum, the toner contained in the developer adheres to the latent image formed on the surface of the photoconductive drum. With this, a toner image is formed on the surface of the photoconductive drum.

Next, a configuration relating to transferring of the image forming unit 21 will be described.

The primary transfer belt 63 is an endless belt wound around the opposing secondary transfer roller 64 and a plurality of winding rollers. The inner surface (inner circumferential surface) of the primary transfer belt 63 contacts the opposing secondary transfer roller 64 and the plurality of winding rollers, and the outer surface (outer circumferential surface) of the primary transfer belt 63 faces the photoconductive drums of the process units 61.

The opposing secondary transfer roller 64 is rotated by a motor (not illustrated). The opposing secondary transfer roller 64 rotates to move the primary transfer belt 63. The plurality of winding rollers are configured to be freely rotatable. The plurality of winding rollers rotate according to the movement of the primary transfer belt 63 by the opposing secondary transfer roller 64.

The plurality of primary transfer rollers 65 are configured to bring the primary transfer belt 63 into contact with the photoconductive drums of the process units 61. The plurality of primary transfer rollers 65 are provided so as to correspond to the plurality of process units 61. More specifically, the plurality of primary transfer rollers 65 are provided at positions facing the photoconductive drums of the corresponding process units 61, respectively, with the primary transfer belt 63 interposed therebetween. The primary transfer roller 65 contacts the inner peripheral surface side of the primary transfer belt 63 and displaces the primary transfer belt 63 toward the photoconductive drum side. With this, the primary transfer roller 65 brings the outer peripheral surface of the primary transfer belt 63 into contact with the photoconductive drum.

The secondary transfer roller 66 is provided at a position facing the primary transfer belt 63. The secondary transfer roller 66 makes contact with the outer peripheral surface of the primary transfer belt 63 and applies pressure to the outer peripheral surface. With this, a transfer nip where the secondary transfer roller 66 and the outer peripheral surface of the primary transfer belt 63 are in close contact is formed. When the print medium P is passed through the transfer nip, the secondary transfer roller 66 presses the print medium P being passed through the transfer nip against the outer peripheral surface of the primary transfer belt 63.

The secondary transfer roller 66 and the opposing secondary transfer roller 64 constitute a portion of the image forming transport path 43. The secondary transfer roller 66 and the opposing secondary transfer roller 64 are rotated to transport the print medium P supplied from the paper feeding transport path 42 while nipping the print medium P. With this, the print medium P is passed through the transfer nip.

In the configuration described above, when the outer peripheral surface of the primary transfer belt 63 contacts the photoconductive drum, the toner image formed on the surface of the photoconductive drum is transferred to the outer peripheral surface of the primary transfer belt 63. The toner image transferred to the outer peripheral surface of the primary transfer belt 63 is moved by the primary transfer belt 63 to the transfer nip where the secondary transfer roller 66 and the outer peripheral surface of the primary transfer belt 63 are in close contact with each other. When the print medium P exists in the transfer nip, the toner image transferred to the outer peripheral surface of the primary transfer belt 63 is transferred to the print medium P at the transfer nip. That is, the toner image on the outer peripheral surface of the primary transfer belt 63 is transferred to the print medium P which is being passed through the transfer nip.

Next, the fixing decolorizing device 22 will be described.

Figure 2:
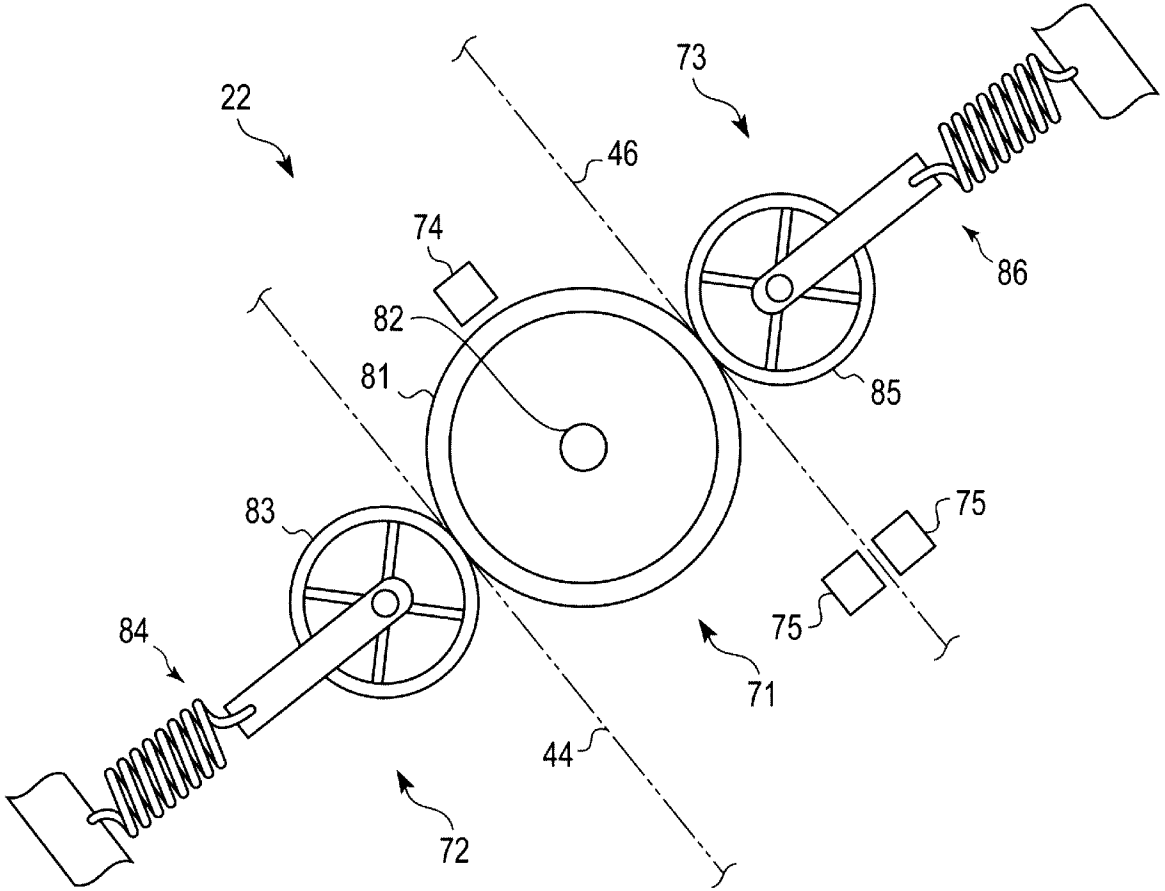
FIG. 2 illustrates a view for explaining a configuration example of a periphery of a fixing device.

FIG. 2 illustrates an explanatory diagram for describing the configuration of the fixing decolorizing device 22.

The fixing decolorizing device 22 fixes the toner image onto the print medium P on which the toner image is formed. Further, the fixing decolorizing device 22 decolorizes an image of the print medium P formed by decolorable toner. The fixing decolorizing device 22 operates based on the control of the system controller 14. The fixing decolorizing device 22 includes a heating member 71, a first pressurizing member 72, a second pressurizing member 73, a temperature sensor 74, and a pair of line sensors 75.

The heating member 71 is configured to apply heat to the print medium P. The heating member 71 includes a heat roller 81 and a heater 82.

The heat roller 81 is a rotating body for fixing that is heated to a high temperature by the heater 82. The heat roller 81 is rotated by a motor (not illustrated). The heat roller 81 includes a core metal formed of metal in a hollow shape and an elastic layer formed on the outer periphery of the core metal.

The heater 82 heats the heat roller 81. The heater 82 is disposed, for example, inside the core metal formed in a hollow shape of the heat roller 81. The heater 82 heats the heat roller 81 from the inside the core metal of the heat roller 81, thereby heating the heat roller 81 to a high temperature. The heater 82 is, for example, a halogen heater. The heater 82 may be an induction heating (IH) heater that heats the core metal by electromagnetic induction.

The first pressurizing member 72 is configured to form a fixing nip for fixing with the heating member 71. The first pressurizing member 72 includes a first press roller 83 and a first pressurization and separation mechanism 84.

The first press roller 83 is provided at a position facing the heat roller 81. The first press roller 83 is rotated by a motor (not illustrated). The first press roller 83 includes a core metal formed of a metal having a predetermined outer diameter and an elastic layer formed on the outer periphery of the core metal.

The first pressurization and separation mechanism 84 switches between a pressurized state and a separated state. The pressurized state is a state in which the first press roller 83 comes into contact with the heat roller 81 and applies pressure to the heat roller 81. The separated state is a state in which the first press roller 83 does not contact the heat roller 81. The first pressurization and separation mechanism 84 includes an elastic body for pressurizing the first press roller 83 against the heat roller 81, a crank and a motor separating the first press roller 83 from the heat roller 81, and the like.

The first pressurizing member 72 forms a fixing nip in which the heat roller 81 and the first press roller 83 are in close contact with each other by allowing the first pressurization and separation mechanism 84 to pressurize the first press roller 83 against the heat roller 81. The first pressurization and separation mechanism 84 separates the first press roller 83 from the heat roller 81, so that the fixing nip is eliminated.

The heat roller 81 and the first press roller 83 constitute a part of the fixing transport path 44. The heat roller 81 and the first press roller 83 rotate to move the print medium P supplied from the image forming transport path 43 in a state of being nipped between the heat roller 81 and the first press roller 83. With this, the print medium P is passed through the fixing nip.

The heating member 71 and the first pressurizing member 72 of the fixing decolorizing device 22 apply pressure to the print medium P which is being passed through the fixing nip while applying heat to the print medium P. With this, the fixing decolorizing device 22 fixes the toner image onto the print medium P. The print medium P passed through the fixing nip is discharged to the outside of the casing 11 through the paper discharge transport path 45.

The second pressurizing member 73 is configured to form a decolorizing nip for decolorizing with the heating member 71. The second pressurizing member 73 includes a second press roller 85 and a second pressurization and separation mechanism 86.

The second press roller 85 is provided at a position facing the heat roller 81. The second press roller 85 is rotated by a motor (not illustrated). The second press roller 85 includes a core metal made of a metal having a predetermined outer diameter and an elastic layer formed on the outer periphery of the core metal.

The second pressurization and separation mechanism 86 switches between a pressurized state and a separated state. The pressurized state is a state in which the second press roller 85 comes into contact with the heat roller 81 and applies pressure to the heat roller 81. The separated state is a state in which the second press roller 85 does not contact the heat roller 81. The second pressurization and separation mechanism 86 includes an elastic body for pressurizing the second press roller 85 against the heat roller 81, a crank and a motor separating the second press roller 85 from the heat roller 81, and the like.

The second pressurizing member 73 forms a decolorizing nip in which the heat roller 81 and the second press roller 85 are in close contact with each other by allowing the second pressurization and separation mechanism 86 to pressurize the second press roller 85 against the heat roller 81. The second pressurization and separation mechanism 86 separates the second press roller 85 from the heat roller 81, so that the decolorizing nip is eliminated.

The heat roller 81 and the second press roller 85 constitute a part of the decolorizing transport path 46. The heat roller 81 and the second press roller 85 rotate to move the print medium P in a state of being nipped between the heat roller 81 and the second press roller 85. With this, the print medium P is passed through the decolorizing nip.

The heating member 71 and the second pressurizing member 73 of the fixing decolorizing device 22 apply heat to the print medium P which is being passed through the decolorizing nip. With this, the image formed by the decolorable toner on the print medium P is decolorized.

The temperature sensor 74 detects a temperature. The temperature sensor 74 detects the temperature in the vicinity of the heating member 71. For example, the temperature sensor 74 detects the temperature of air located at a predetermined distance from the heat roller 81. The temperature sensor 74 may be provided at a position at which at least the change in the temperature of the heat roller 81 can be detected. The temperature sensor 74 supplies the detection result to the system controller 14.

The pair of line sensors 75 acquires an image of the print medium P passed through the decolorizing nip. The pair of line sensors 75 is provided, for example, so that the decolorizing transport path 46 is nipped between the pair of line sensors 75. With this, the pair of line sensors 75 acquires the image of the front side and the back side of the print medium P passed through the decolorizing nip. The pair of line sensors 75 supplies the acquired image to the system controller 14. The fixing decolorizing device 22 may be configured to include one line sensor that acquires an image of one surface of the print medium P passed through the decolorizing nip. The fixing decolorizing device 22 may be configured not to include a line sensor but an area sensor.

In the configuration described above, based on the image acquired by the line sensor 75, the system controller 14 determines whether or not a decolorization residue (image of decolorable toner remaining on the print medium P) is present on the print medium P passed through the decolorizing nip. When it is determined that the decolorization residue is present, the print medium P is introduced into the re-decolorizing transport path 47 by the guide 51. With this, the print medium P is passed through the decolorizing nip again. When it is determined that the decolorization residue is not present, the print medium P is introduced into the recursive transport path 48 by the guide 51. With this, the print medium P is supplied to the paper cassette 17. As a result, the print medium P can be reused. In the case the fixing decolorizing device 22 configured to include one line sensor 75 that acquires an image of one surface of the print medium P passed through the decolorizing nip, the print medium P may be introduced into the re-decolorizing transport path 47 by the guide 51 at least once regardless of whether or not a decolorization residue. With this, the line sensor 75 can acquire the image of the front side and the back side of the print medium P passed through the decolorizing nip.

Next, the operation of the image forming apparatus 1 will be described.

Figure 3:
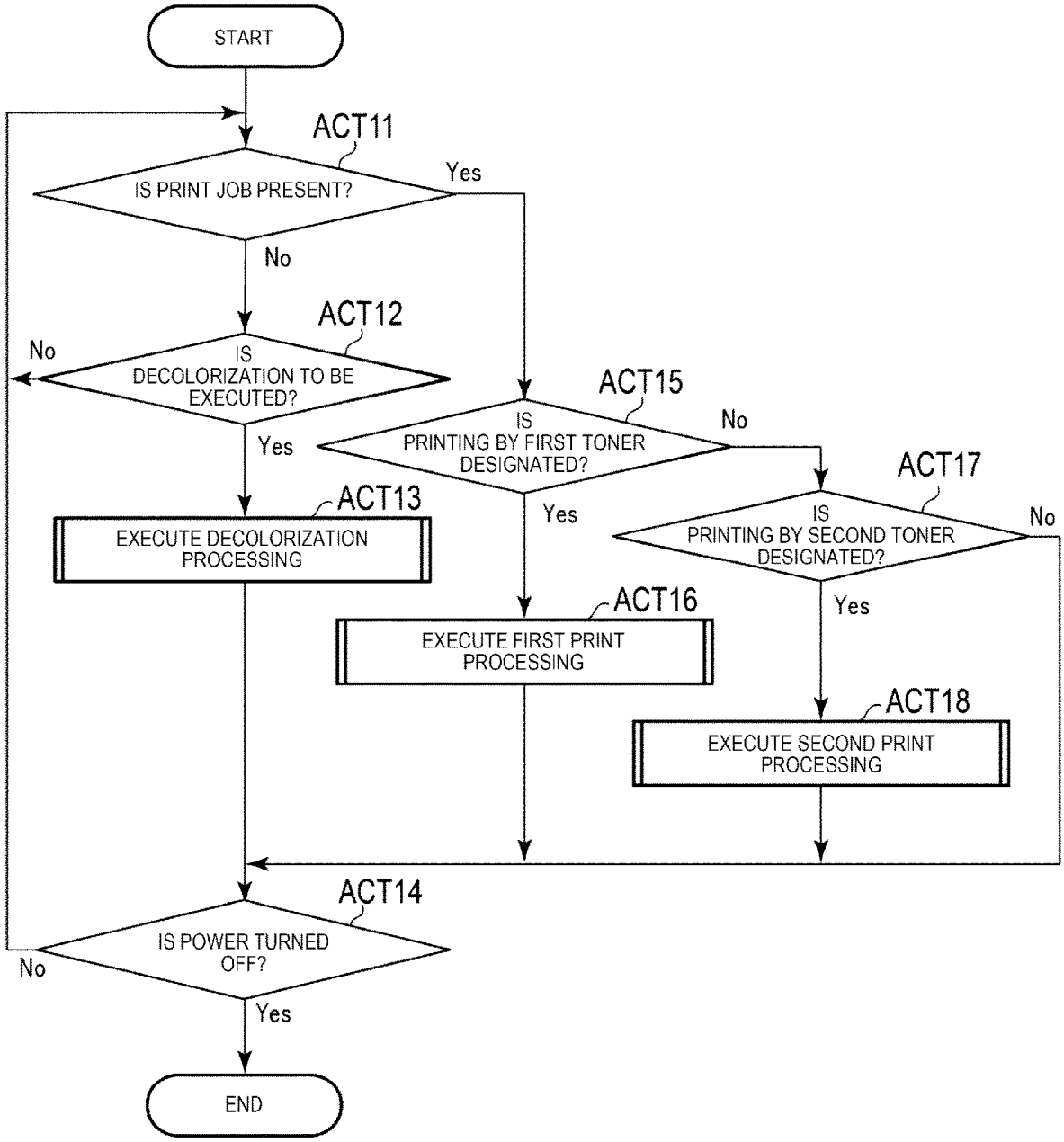
FIG. 3 illustrates a flowchart for explaining an example of an operation.

FIG. 3 illustrates a flowchart for explaining the operation of the image forming apparatus 1. In the configuration described above, the processor 31 of the system controller 14 executes a program stored in the memory 32 to perform processing of generating a print job for forming an image on the print medium P. For example, the processor 31 generates a print job based on, for example, an image acquired from an external device via the communication interface 13 or an image acquired by the image reading unit 12. The processor 31 stores the generated print job in the memory 32.

The print job includes image data indicating an image to be formed on the print medium P. The image data may be data for forming an image on one print medium P or data for forming an image on a plurality of print medium P. The print job includes information indicating whether printing is performed by color toner (first toner) or decolorable toner (second toner).

When the power supply of the image forming apparatus 1 is turned on, the processor 31 determines the presence or absence of a print job (ACT 11). When it is determined that the print job is not present (NO in ACT 11), the processor 31 determines whether or not to execute decolorization processing (ACT 12). The processor 31 determines, based on the detection result of the sensor 41, whether or not the print medium P is disposed on the decolorization tray 19. The processor 31 determines whether or not an operation instructing execution of the decolorization processing is input by the operation interface 16. When it is determined that the print medium P is disposed on the decolorization tray 19 and that the operation instructing the execution of the decolorization processing is input, the processor 31 determines to execute the decolorization processing.

When it is determined that the decolorization processing is not to be executed (NO in ACT 12), the processor 31 proceeds to processing of ACT 11. When it is determined that the decolorization processing is to be executed (YES in ACT 12), the processor 31 executes decolorization processing which will be described later (ACT 13).

When the decolorization processing is executed, the processor 31 determines whether or not the power supply of the image forming apparatus 1 is turned off (ACT 14). When it is determined that the power supply of the image forming apparatus 1 is turned off (YES in ACT 14), the processor 31 stops supply of power from the power supply circuit, and ends processing of FIG. 3. When it is determined that the power supply of the image forming apparatus 1 is not turned off (NO in ACT 14), the processor 31 proceeds to processing of ACT 11.

When it is determined, in the ACT 11, that the print job is present (ACT 11, YES), the processor 31 determines whether or not printing by color toner (first toner) is designated in the print job (ACT 15). When it is determined that the printing by the color toner is designated (YES in ACT 15), the processor 31 executes first print processing (ACT 16) to be described later and proceeds to processing of ACT 14.

When it is determined, in ACT 15, that the printing by the color toner is not designated (NO in ACT 15), the processor 31 determines whether or not printing by decolorable toner (second toner) is designated in the print job (ACT 17). When it is determined that the printing by the decolorable toner is designated (YES in ACT 17), the processor 31 executes second print processing (ACT 18) to be described later and proceeds to processing of ACT 14.

Next, the decolorization processing in ACT 13 of FIG. 3 will be described.

Figure 4:
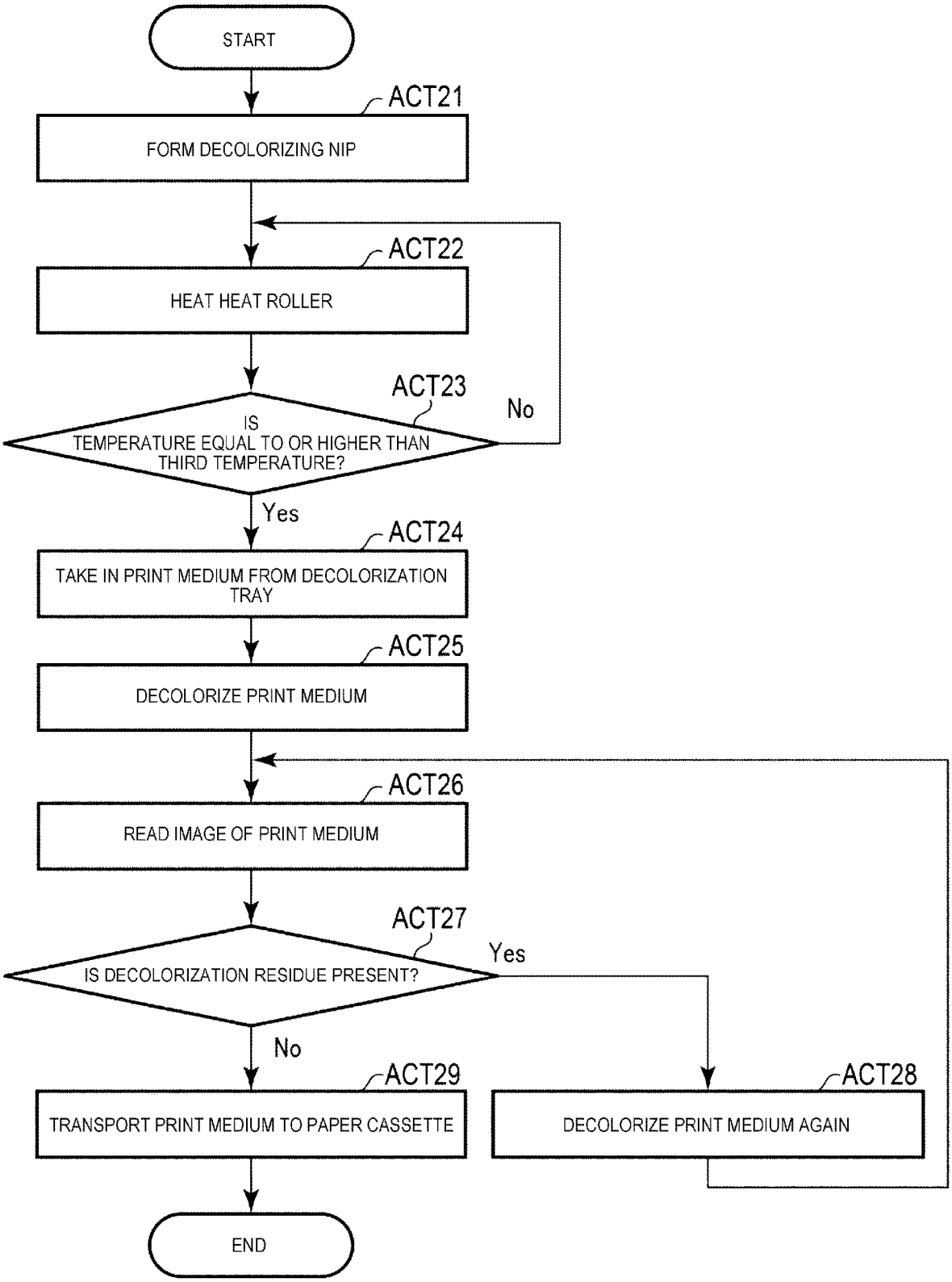
FIG. 4 illustrates a flowchart for explaining an example of another operation.

FIG. 4 illustrates a flowchart for explaining decolorization processing. The processor 31 controls the fixing decolorizing device 22 to form the decolorizing nip (ACT 21). The processor 31 brings the second press roller 85 into contact with the heat roller 81 and applies pressure to the heat roller 81 by the second pressurization and separation mechanism 86. With this, the processor 31 causes the decolorizing nip to be formed. That is, the processor 31 controls the fixing decolorizing device 22 so as not to form the fixing nip and form the decolorizing nip.

The processor 31 controls the fixing decolorizing device 22 to heat the heat roller 81 (ACT 22). The processor 31 controls the heater 82 so as to heat the heat roller 81 by electric power of a power supply circuit (not illustrated).

The processor 31 determines whether or not the temperature of the heat roller 81 is equal to or higher than the decolorizing temperature (third temperature) required for decolorization processing (ACT 23). For example, when the detection result of the temperature sensor 74 of the fixing decolorizing device 22 exceeds a preset threshold value, the processor 31 determines that the temperature of the heat roller 81 is equal to or higher than the third temperature. The processor 31 may be configured to determine whether or not the detection result of the temperature sensor 74 of the fixing decolorizing device 22 becomes equal to or higher than the third temperature. When it is determined that the temperature of the heat roller 81 is lower than the third temperature (NO in ACT 23), the processor 31 proceeds to processing of the ACT 22. As a result, the processor 31 continues to heat the heat roller 81 by the heater 82 until the temperature of the heat roller 81 becomes equal to or higher than the third temperature.

When it is determined that the temperature of the heat roller 81 is equal to or higher than the third temperature (YES in ACT 23), the processor 31 causes the print medium P to be taken in the decolorizing transport path 46 from the decolorization tray 19 (ACT 24). For example, the processor 31 rotates the pickup roller 50 of the decolorizing transport path 46 to cause the print medium P to be taken into the decolorizing transport path 46 from the decolorization tray 19.

The processor 31 decolorizes the print medium P taken into the decolorizing transport path 46 by the fixing decolorizing device 22 (ACT 25). That is, the processor 31 controls the transport unit 20 and the fixing decolorizing device 22 to allow the print medium P taken into the decolorizing transport path 46 to pass through the decolorizing nip. With this, heat is applied to the print medium P from the heat roller 81 of the fixing decolorizing device 22. As a result, the image formed on the print medium P by the decolorable toner is decolorized.

The processor 31 controls the line sensor 75 to read the image of the print medium P passed through the decolorizing nip (ACT 26).

The processor 31, based on the image read by the line sensor 75, determines whether or not a decolorization residue is present (ACT 27). When the image read by the line sensor 75 has a color different from the color of the substrate of the print medium P, the processor 31 determines that a decolorization residue is present.

When it is determined that a decolorization residue is present (YES in ACT 27), the processor 31 allows the print medium P to pass through the decolorizing nip again (ACT 28) by controlling the transport unit 20, and proceeds to the processing of ACT 26. Specifically, the processor 31 controls the guide 51 so that the print medium P being transported through the decolorizing transport path 46 is introduced into the re-decolorizing transport path 47. Through the re-decolorizing transport path 47, the introduced print medium P is supplied to the upstream side of the decolorizing nip of the decolorizing transport path 46. With this, the print medium P supplied to the decolorizing transport path 46 again is passed through the decolorizing nip. The processor 31 repeats processing of the ACT 26 to the ACT 28 until a decolorization residue is not present.

When it is determined that the decolorization residue is not present (NO in ACT 27), the processor 31 controls the transport unit 20 to transport the print medium P to the paper cassette 17 (ACT 29), and ends the decolorization processing. Specifically, the processor 31 controls the guide 51 so that the print medium P being transported through the decolorizing transport path 46 is introduced into the recursive transport path 48. Furthermore, the processor 31 controls the recursive transport path 48 so that the print medium P introduced into the recursive transport path 48 is supplied to the paper cassette 17. With this, the print medium P is supplied to the paper cassette 17 in a decolorized state. As a result, the print medium P can be reused.

Next, second print processing in the ACT 18 of FIG. 3 will be described.

Figure 5:
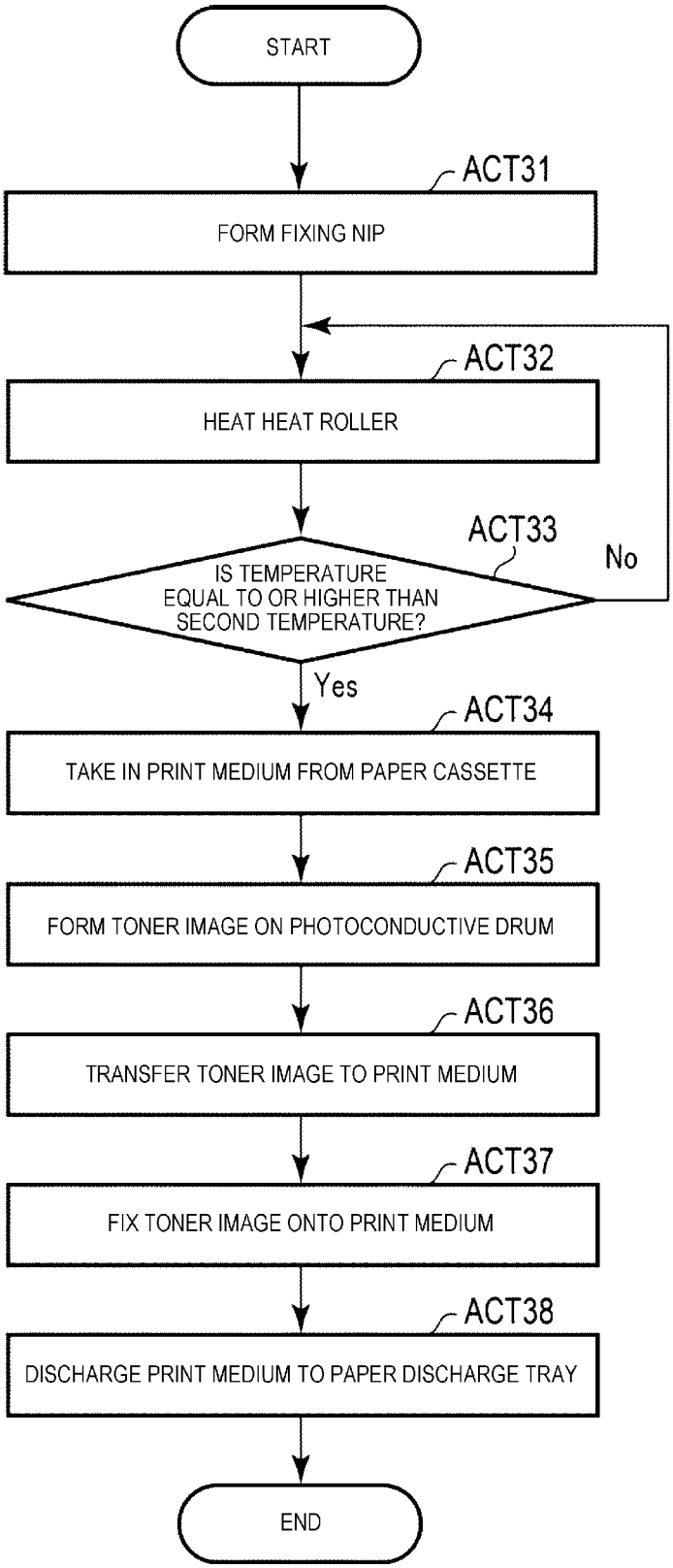
FIG. 5 illustrates a flowchart for explaining an example of still another operation.

FIG. 5 illustrates a flowchart for explaining second print processing. The second print processing is processing of forming an image on the print medium P with decolorable toner (second toner). The processor 31 controls the fixing decolorizing device 22 to form a fixing nip (ACT 31). The processor 31 brings the first press roller 83 into contact with the heat roller 81 and applies pressure to the heat roller 81 by the first pressurization and separation mechanism 84. With this, the processor 31 causes a fixing nip to be formed. That is, the processor 31 controls the fixing decolorizing device 22 so as to form the fixing nip and not to form the decolorizing nip.

The processor 31 controls the fixing decolorizing device 22 to heat the heat roller 81 (ACT 32). The processor 31 controls the heater 82 so as to heat the heat roller 81 by the electric power of a power supply circuit (not illustrated).

The processor 31 determines whether or not the temperature of the heat roller 81 is equal to or higher than the fixing temperature (second temperature) required for fixing the decolorable toner (ACT 33). For example, when the detection result of the temperature sensor 74 of the fixing decolorizing device 22 exceeds a preset threshold value, the processor 31 determines that the temperature of the heat roller 81 is equal to or higher than the second temperature. The processor 31 may be configured to determine whether or not the detection result of the temperature sensor 74 of the fixing decolorizing device 22 is equal to or higher than the second temperature. When it is determined that the temperature of the heat roller 81 is lower than the second temperature (NO in ACT 33), the processor 31 proceeds to processing of ACT 32. With this, the processor 31 continues to heat the heat roller 81 by the heater 82 until the temperature of the heat roller 81 becomes equal to or higher than the second temperature.

When it is determined that the temperature of the heat roller 81 is equal to or higher than the second temperature (YES in ACT 33), the processor 31 controls the transport unit 20 so as to cause the print medium P to be taken into the paper feeding transport path 42 from the paper cassette 17 (ACT 34). Through the paper feeding transport path 42, the taken print medium P is supplied to the image forming transport path 43.

Based on the print job, the processor 31 controls the image forming unit 21 so as to form a toner image of the second toner on the photoconductive drum of the process unit 61 corresponding to the decolorable toner (second toner) (ACT 35). Specifically, the processor 31 rotates the photoconductive drum, turns the electrifying charger on, and uniformly charges the surface of the photoconductive drum. Furthermore, the processor 31 causes the exposing device 62 corresponding to the second toner to form an electrostatic latent image on the photoconductive drum of the process unit 61 corresponding to the second toner. With this, the processor 31 causes an electrostatic latent image corresponding to image data of the print job to be formed on the surface of the photoconductive drum. Furthermore, the processor 31 attaches the second toner to the electrostatic latent image on the photoconductive drum by the developing device. With this, the processor 31 causes the toner image of the second toner corresponding to the image data of the print job to be formed on the surface of the photoconductive drum.

The processor 31 controls the image forming unit 21 to transfer the toner image formed on the photoconductive drum onto the print medium P (ACT 36). Specifically, the processor 31 rotates the opposing secondary transfer roller 64 and the secondary transfer roller 66 to move the outer peripheral surface of the primary transfer belt 63 in a state of being in contact with the photoconductive drum. When the outer peripheral surface of the primary transfer belt 63 contacts the photoconductive drum, the toner image formed on the surface of the photoconductive drum is transferred to the outer peripheral surface of the primary transfer belt 63. The toner image transferred to the outer peripheral surface of the primary transfer belt 63 is moved by the primary transfer belt 63 to the transfer nip where the secondary transfer roller 66 and the outer peripheral surface of the primary transfer belt 63 are in close contact with each other. The processor 31 causes the print medium P to pass through the transfer nip in a state where the toner image transferred to the primary transfer belt 63 is in contact with the print medium P supplied from the paper feeding transport path 42. With this, the toner image on the outer peripheral surface of the primary transfer belt 63 is transferred to the print medium P which is being passed through the transfer nip. The image forming transport path 43 supplies the print medium P to which the toner image is transferred to the fixing transport path 44.

The processor 31 controls the transport unit 20 and the fixing decolorizing device 22 to fix the toner image transferred to the print medium P onto the print medium P (ACT 37). Specifically, the processor 31 rotates the heat roller 81 and the first press roller 83 to allow the print medium P supplied to the fixing transport path 44 to pass through the fixing nip. The heat roller 81 and the first press roller 83 apply heat and pressure to the print medium P which is being passed through the fixing nip. As a result, the toner image is fixed onto the print medium P passed through the fixing nip. Through fixing transport path 44, the print medium P passed through the fixing nip is supplied to the paper discharge transport path 45.

The processor 31 controls the transport unit 20 to discharge the print medium P supplied to the paper discharge transport path 45 to the paper discharge tray 18 (ACT 38), and ends the second print processing. With this, the print medium P on which the image is formed with the decolorable toner is stacked on the paper discharge tray 18.

Next, the first print processing in ACT 16 of FIG. 3 will be described.

Figure 6:
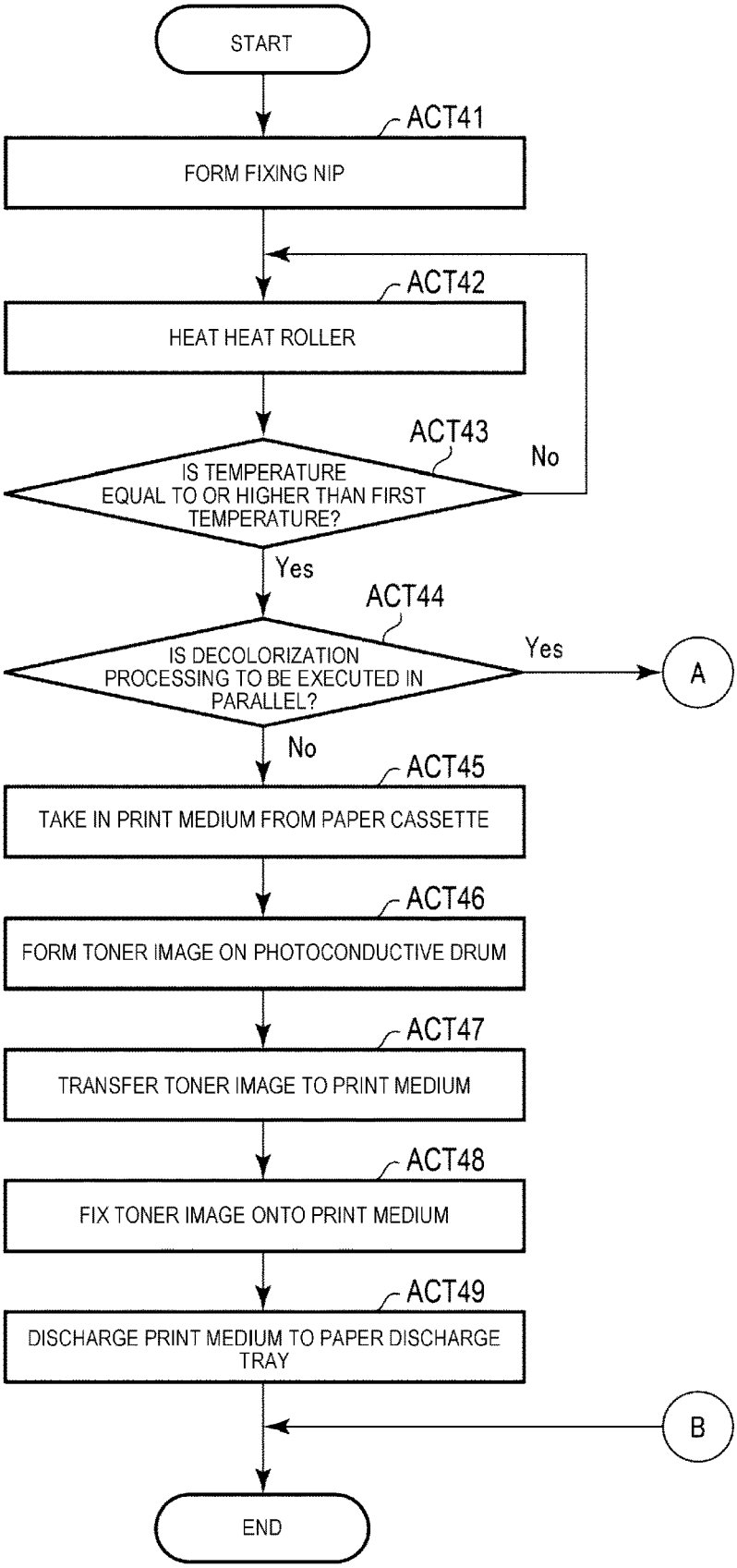
FIG. 6 illustrates a flowchart for explaining an example of still another operation.
Figure 7:
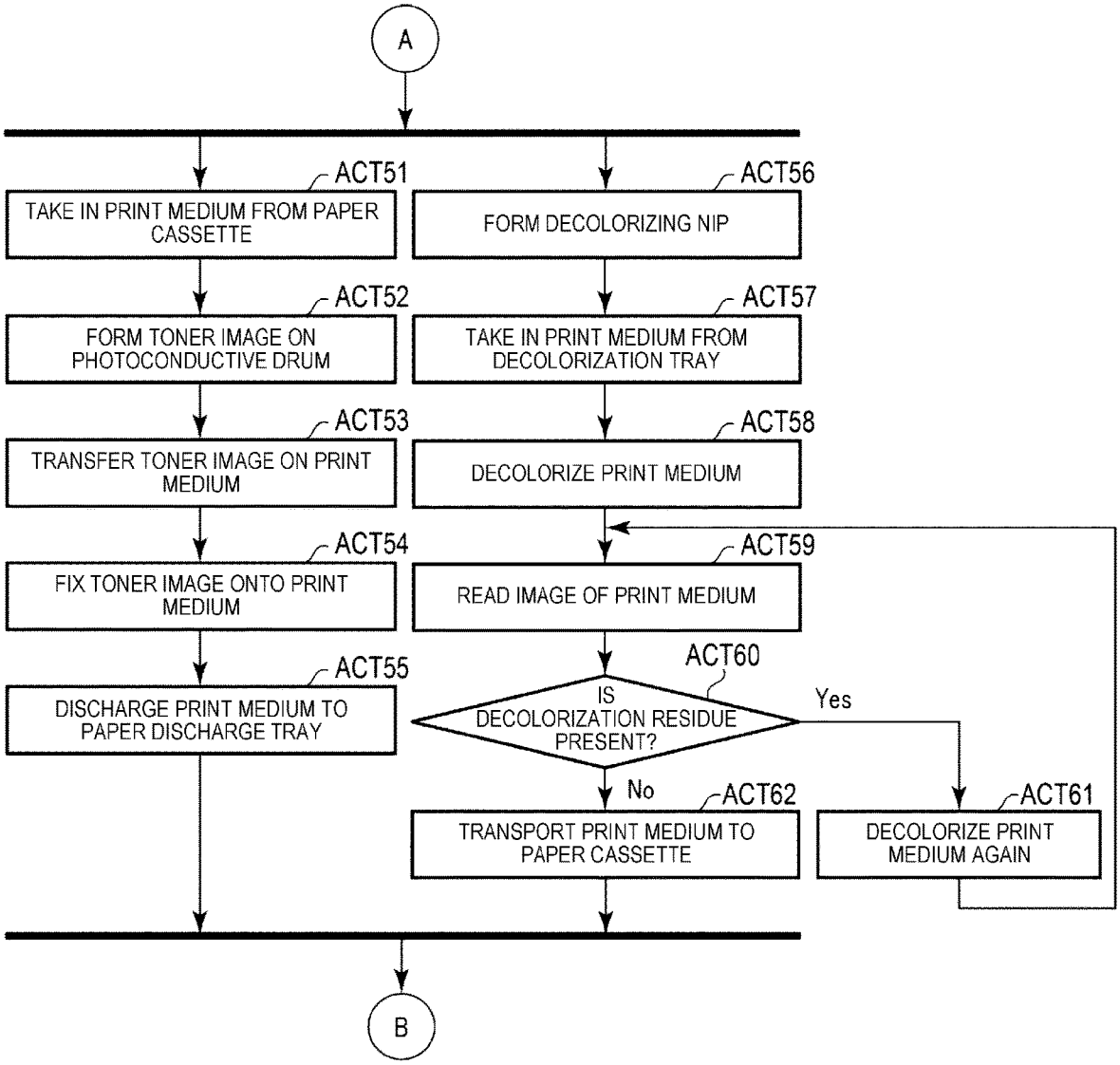
FIG. 7 illustrates a flowchart for explaining an example of still another operation.

FIGS. 6 and 7 are flowcharts for explaining the first print processing. The first print processing is processing of forming an image on the print medium P with color toner (first toner). The processor 31 controls the fixing decolorizing device 22 to forma fixing nip (ACT 41). That is, the processor 31 controls the fixing decolorizing device 22 so as to form the fixing nip and not to form a decolorizing nip.

The processor 31 controls the fixing decolorizing device 22 to heat the heat roller 81 (ACT 42).

The processor 31 determines whether or not the temperature of the heat roller 81 is equal to or higher than the fixing temperature (first temperature) required for fixing the color toner (ACT 43). For example, when the detection result of the temperature sensor 74 of the fixing decolorizing device 22 exceeds a preset threshold value, the processor 31 determines that the temperature of the heat roller 81 is equal to or higher than the first temperature. The processor 31 may be configured to determine whether or not the detection result of the temperature sensor 74 of the fixing decolorizing device 22 is equal to or higher than the first temperature. When it is determined that the temperature of the heat roller 81 is lower than the first temperature (NO in ACT 43), the processor 31 proceeds to processing of ACT 42. With this, the processor 31 continues to heat the heat roller 81 by the heater 82 until the temperature of the heat roller 81 becomes equal to or higher than the first temperature.

When it is determined that the temperature of the heat roller 81 is equal to or higher than the first temperature (YES in ACT 43), the processor 31 determines whether or not to execute the decolorization processing in parallel (ACT 44). For example, at the time of executing the first print processing, the processor 31 determines whether or not to execute the decolorization processing in parallel based on the setting (parallel processing setting) indicating whether or not to perform the decolorization processing in parallel. The parallel processing setting is stored in the memory 32, for example. The processor 31 changes the parallel processing setting stored in the memory 32 based on the operation of the operation interface 16 or information received via the communication interface 13. Specifically, when the parallel processing setting indicates that the first print processing and the decolorization processing are executed to be in parallel and the print medium P is disposed in the decolorization tray 19, the processor 31 determines to execute the decolorization processing in parallel.

When it is determined that the decolorization processing is not to be executed in parallel (NO in ACT 44), the processor 31 controls the transport unit 20 to take the print medium P from the paper cassette 17 into the paper feeding transport path 42 (ACT 45). The paper feeding transport path 42 supplies the taken print medium P to the image forming transport path 43.

The processor 31 controls the image forming unit 21 so as to form a toner image of the first toner on the photoconductive drum of the process unit 61 corresponding to the color toner (first toner), based on the print job. (ACT 46).

The processor 31 controls the image forming unit 21 to transfer the toner image formed on the photoconductive drum to the print medium P (ACT 47).

The processor 31 controls the transport unit 20 and the fixing decolorizing device 22 to fix the toner image transferred to the print medium P onto the print medium P (ACT 48).

The processor 31 controls the transport unit 20 to discharge the print medium P supplied to the paper discharge transport path 45 to the paper discharge tray 18 (ACT 49), and ends the first print processing. With this, the print medium P on which the image is formed with the color toner is stacked on the paper discharge tray 18.

When it is determined in ACT 44 that decolorization processing is to be executed in parallel (YES in ACT 44), the processor 31 proceeds to FIG. 7, and executes printing by color toner and decolorization processing in parallel.

As illustrated in FIG. 7, the processor 31 causes the print medium P to be taken into the paper feeding transport path 42 from the paper cassette 17 (ACT 51). The processor 31 controls the image forming unit 21 so as to form the toner image of the first toner on the photoconductive drum of the process unit 61 corresponding to the color toner (first toner), based on the print job (ACT 52). The processor 31 controls the image forming unit 21 to transfer the toner image formed on the photoconductive drum to the print medium P (ACT 53). The processor 31 controls the transport unit 20 and the fixing decolorizing device 22 to fix the toner image transferred to the print medium P onto the print medium P (ACT 54). The processor 31 controls the transport unit 20 to discharge the print medium P supplied to the paper discharge transport path 45 to the paper discharge tray 18 (ACT 55).

Furthermore, at the same time that processing of ACT 51 to ACT 55 is performed, the processor 31 executes processing of ACT 56 to ACT 62 to be described later.

First, the processor 31 controls the fixing decolorizing device 22 to form the decolorizing nip (ACT 56). That is, the processor 31 controls the fixing decolorizing device 22 so that the fixing nip and the decolorizing nip are formed. The processor 31 causes the print medium P to be taken into the decolorizing transport path 46 from the decolorization tray 19 (ACT 57). The processor 31 decolorizes the print medium P taken into the decolorizing transport path 46 by the fixing decolorizing device 22 (ACT 58). That is, the processor 31 controls the transport unit 20 and the fixing decolorizing device 22 to allow the print medium P taken into the decolorizing transport path 46 to pass through the decolorizing nip. The heat roller 81 increases the temperature to the first temperature which is higher than the third temperature for fixing. Therefore, as the print medium P is passed through the decolorizing nip, the image formed with the decolorable toner on the print medium P is decolorized.

Furthermore, the processor 31 controls the line sensor 75 to read the image of the print medium P passed through the decolorizing nip (ACT 59). Based on the image read by the line sensor 75, the processor 31 determines whether or not a decolorization residue is present (ACT 60). When it is determined that the decolorization residue is present (YES in ACT 60), the processor 31 controls the transport unit 20 to cause the print medium P to pass through the decolorizing nip again by (ACT 61), and proceeds to processing of ACT 59. When it is determined in ACT 60 that the decolorization residue is not present (NO in ACT 60), the processor 31 controls the transport unit 20 to transport the print medium P to the paper cassette 17 (ACT 62).

When processing of the ACT 55 and processing of the ACT 62 are ended, the processor 31 ends the first print processing. The processor 31 may be configured to continue processing of the ACT 56 to the ACT 62 when processing of the ACT 62 is ended earlier than processing of the ACT 55 and there is a subsequent print job.

As described above, the processor 31 of the system controller 14 of the image forming apparatus 1 controls the heat roller 81 of the heating member 71 to the first temperature. The processor 31 allows the print medium P on which the toner image is formed by the color toner (first toner) to pass through the fixing nip for fixing in which the heating member 71 and the first pressurizing member are in close contact with each other. With this, the toner image of the first toner formed on the print medium P is fixed onto the print medium P. Furthermore, the processor 31 causes the print medium P on which the image is formed by the second toner to pass through the decolorizing nip for decolorizing in which the heating member 71 and the second pressurizing member are in close contact with each other. With this, the image which is formed by the second toner, is fixed at the second temperature lower than the first temperature, and is decolorized at the third temperature which is higher than the second temperature and lower than the first temperature, is decolorized. According to such a configuration, since decolorization in the decolorizing nip can be performed by the heat used for fixing, the image forming apparatus 1 can suppress power consumption.

Since the decolorizing nip and the fixing nip are separately configured, the image forming apparatus 1 can perform decolorization of the print medium P on which the image is formed with the decolorable toner and print processing on the print medium P at the same time. That is, the processor 31 can execute processing of forming the toner image on the print medium P by the first toner and passing the print medium P on which the toner image is formed by the first toner through the fixing nip and decolorization processing for passing the print medium P on which the image is formed by the second toner to the decolorizing nip in parallel.

When the decolorization processing is not executed in parallel in the first print processing, the processor 31 controls the fixing decolorizing device 22 so as to form the fixing nip and not to form the decolorizing nip. With this, the image forming apparatus 1 can prevent heat of the heat roller 81 from being transmitted to the second press roller 85 via the decolorizing nip. As a result, the image forming apparatus 1 can prevent heat of the heat roller 81 from diverging.

Further, when the second print processing is executed, the processor 31 controls the fixing decolorizing device 22 so as to form a fixing nip and not to form a decolorizing nip. With this, the image forming apparatus 1 can prevent heat of the heat roller 81 from being transmitted to the second press roller 85 via the decolorizing nip. As a result, the image forming apparatus 1 can prevent heat of the heat roller 81 from diverging.

When only the decolorization processing is executed, the processor 31 controls the fixing decolorizing device 22 so as not to form a fixing nip and form a decolorizing nip. With this, the image forming apparatus 1 can prevent heat of the heat roller 81 from being transmitted to the first press roller 83 via the fixing nip. As a result, the image forming apparatus 1 can prevent heat of the heat roller 81 from diverging.

The processor 31 controls the transport unit 20 so as to transport the print medium P passed through the decolorizing nip to the paper cassette 17. The processor 31 also controls the image forming unit and the transport unit 20 so that the print medium P of the paper cassette 17 is transported to the image forming unit 21 and an image is formed. With this, the image forming apparatus 1 can reuse the print medium P in which the image of the decolorable toner is decolorized for printing.

The functions described in the embodiment described above can be realized not only by using hardware but also by reading a program describing each function using software into a computer. Further, each function may be configured by selecting software or hardware as appropriate.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a paper feeding transport unit configured to transport a print medium, the paper feeding transport unit includes a fixing transport path and a decolorizing transport path;

an image forming unit configured to form a toner image on the print medium;

a heating member;

a first pressurizing member configured to form a fixing nip for fixing with the heating member;

a second pressurizing member configured to form a decolorizing nip for decolorizing with the heating member; and a processor configured to control the heating member to a first temperature to allow the print medium on which the toner image is formed by a first toner to pass through the fixing nip by the fixing transport path and allow the print medium on which an image is formed by a second toner, which is fixed at a second temperature lower than the first temperature and is decolorized at a third temperature which is higher than the second temperature and lower than the first temperature, to pass through the decolorizing nip by the decolorizing transport path, the print medium on which the image is formed by the second toner is different from the print medium on which the toner image is formed by the first toner.

2. The apparatus according to claim 1, wherein the processor is configured to cause a toner image to be formed on the print medium by the first toner and to perform print processing for allowing the print medium on which the toner image is formed by the first toner to pass through the fixing nip and decolorization processing for allowing the print medium on which the image is formed by the second toner to pass through the decolorizing nip in parallel.

3. The apparatus according to claim 2, wherein the processor is configured to perform control so as to form the fixing nip and not to form the decolorizing nip when the print processing is performed and the decolorization processing is not performed.

4. The apparatus according to claim 2, wherein the processor is configured to form the decolorizing nip without forming the fixing nip when the print processing is not performed and the decolorization processing is performed.

5. The apparatus according to claim 1, wherein the paper feeding transport unit is configured to transport the print medium passed through the decolorizing nip to a paper cassette and transport the print medium of the paper cassette to the image forming unit.

6. The apparatus according to claim 1, wherein the heating member is a halogen heater.

7. The apparatus according to claim 1, wherein the heating member is an induction heater.

8. A control method of an image forming apparatus including a paper feeding transport unit configured to transport a print medium, the paper feeding transport unit includes a fixing transport path and a decolorizing transport path, an image forming unit configured to form a toner image on the print medium, a heating member, a first pressurizing member configured to form a fixing nip for fixing with the heating member, a second pressurizing member configured to form a decolorizing nip for decolorizing with the heating member, and a processor, the method comprising:

causing the processor to control the heating member to a first temperature; and allow the print medium on which the toner image is formed by a first toner to pass through the fixing nip by the fixing transport path, and allow the print medium on which an image is formed by a second toner, which is fixed at a second temperature lower than the first temperature and is decolorized at a third temperature which is higher than the second temperature and lower than the first temperature, to pass through the decolorizing nip by the decolorizing transport path, the print medium on which the image is formed by the second toner is different from the print medium on which the toner image is formed by the first toner.

9. The control method according to claim 8, further comprising:

causing a toner image to be formed on the print medium by the first toner and performing print processing for allowing the print medium on which the toner image is formed by the first toner to pass through the fixing nip and decolorization processing for allowing the print medium on which the image is formed by the second toner to pass through the decolorizing nip in parallel.

10. The control method according to claim 9, further comprising:

forming the fixing nip and not forming the decolorizing nip when the print processing is performed and the decolorization processing is not performed.

11. The control method according to claim 9, further comprising:

forming the decolorizing nip without forming the fixing nip when the print processing is not performed and the decolorization processing is performed.

12. The control method according to claim 8, further comprising:

transporting the print medium passed through the decolorizing nip to a paper cassette and transporting the print medium of the paper cassette to the image forming unit.

13. The control method according to claim 8, wherein the heating member is a halogen heater.

14. The control method according to claim 8, wherein the heating member is an induction heater.

* * * * *